US005919004A

United States Patent [19]

Christenson

[11] Patent Number: 5,919,004

[45] Date of Patent: Jul. 6, 1999

[54] METHOD AND APPARATUS FOR PROTECTIVE ENCAPSULATION OF STRUCTURAL MEMBERS

[76] Inventor: John Christenson, 585 Midwood Ave., Brick, N.J. 08724

[21] Appl. No.: 08/975,136

[22] Filed: Nov. 20, 1997

[51] Int. Cl.[6] ..... E02D 5/60; E02D 5/64

[52] U.S. Cl. ..... 405/216; 405/211.1

[58] Field of Search ..... 405/211, 211.1, 405/216, 233

[56] References Cited

U.S. PATENT DOCUMENTS

| | | | |
|---|---|---|---|
| Re. 35,322 | 9/1996 | Owen et al. | 405/216 X |
| 1,512,660 | 10/1924 | Wright et al. | 405/216 X |
| 3,027,610 | 4/1962 | Liddell | 405/216 |
| 3,417,569 | 12/1968 | Laughlin | 405/216 |
| 3,708,146 | 1/1973 | Lamberton | 249/1 |
| 3,719,049 | 3/1973 | Shaw et al. | 405/216 |
| 4,023,374 | 5/1977 | Colbert et al. | 405/216 |
| 4,764,054 | 8/1988 | Sutton | 405/216 |
| 4,983,072 | 1/1991 | Bel, Jr. | 405/216 |
| 5,129,762 | 7/1992 | Legendre | 405/232 |
| 5,138,806 | 8/1992 | Marx et al. | 405/216 X |
| 5,326,410 | 7/1994 | Boyles | 405/216 X |
| 5,516,236 | 5/1996 | Williams et al. | 405/216 |
| 5,586,838 | 12/1996 | Walsh | 405/216 |

*Primary Examiner*—David J. Bagnell
*Assistant Examiner*—Tara L. Mayo
*Attorney, Agent, or Firm*—Clifford G. Frayne

[57] ABSTRACT

A method and apparatus for creating a controlled environment about a pile submerged in a body of water in order to prevent marine infestation or further marine infestation, the apparatus in process comprising a tubular jacket installed about the submerged pile exposed to water, and introducing a marine grade foam between the tubular jacket and the pile thereby displacing any water between the tubular jacket and the pile, the foam upon setting, forms a rigid strata between the tubular jacket and the submerged pile thereby denying the surface of the pile exposure to water.

10 Claims, 4 Drawing Sheets

METHOD AND APPARATUS FOR PROTECTIVE ENCAPSULATION OF STRUCTURAL MEMBERS

BACKGROUND OF THE INVENTION

1. Field of the Invention

This invention relates generally to the field of encasement or encapsulation of structural members, and more particularly to the encasement or encapsulation of structural members partially submerged in either fresh water or salt water.

2. Background of the Invention

The use of piles or piers as structural supports for wharfs, bridges and other marine environment structures is well known. The usual materials of construction for such marine structures are concrete, steel, wood or a combination or composite of two or more of these materials. All of the aforementioned materials of construction are vulnerable to deterioration. In particular, wooden pilings have been used for many years to support piers, wharfs, boat slips, and in some instances older bridges. It is well known that such piling is subject to many hazards necessitating the replacement of same. One major source of damage which drastically shortens the life expectancy of wood piling is the attack on the piling by certain marine parasites and microorganisms. These marine microorganisms feed upon the cellulose material of the wood piling extracting a food substance of a polysaccharide carbohydrate nature.

Particular marine microorganisms known to attack wooden pilings include limnoria, gribbles and teredo microorganisms. The teredo begins life as a larva and begins its metamorphosis into an adult when it has attached itself to the surface of a piece of submerged timber. The teredo will begin burrowing into the submerged timber and its tail appendage will seal off the entry way. The only visible presence of a teredo is the occurrence of two microscopic syphon tubes, one for the inhalation of fresh water and the other for exhalation. In its boring, the toredo will dispose of waste through the exhalation syphon and the inhalation syphon is designed to produce continuously circulating water over the toredo's gills for the absorption of oxygen. New larva is also disposed of through the exhalation syphon to infest the same submerged timber or other timber. The specific danger with the toredo is that the submerged timber pile appears to be secure and intact, when in fact, the interior of the pile may contain a great deal of infestation thus weakening the pile.

The second marine borer, of the limnoria species, which is sometimes referred to as a gribble, resembles lice and is about the size of a small ant and it is capable of boring holes of approximately 3 mm in diameter. The limnoria rarely penetrate the timber for more than 10 to 12 millimeters, but they normally infest in great numbers on the outer layer of the submerged timber such that the submerged timber takes on a honeycombed appearance with tiny individual channels. This attack combined with the eroding effects of the sea's tide will break down the surface of the wood and expose new surfaces for attack.

Previous efforts to safeguard these hazards include the impregnation of the structures and/or the coating of their surfaces with special preservatives and protective coatings using materials such as creosote, tar and impervious paints. While these materials do cover certain hazards, they are in ineffective with respect to others and the chemical treatments are subject to leeching, scaling and erosion by the action of the constantly moving surrounding water, taken together with temperature changes and shock forces.

Further, the high salinity and other constituents of sea water also contribute to degradation of these protective measures.

Various guard devices have been proposed for installation about pilings to solve the infestation problem. One prior art protective measure involved enclosing portions of the piling in direct contact with the water with a sheet of plastic by wrapping the sheet tightly around the pile. The piling has also been encased with rigid polyvinyl chloride tubing. This method attempts to provide a barrier to access by marine life not readily present in or on the piling and traps that marine life present in and on the pilings inside the jacket. The intent of the wrapping is to trap a thin layer of water between the wrapping and the wooden pile and to prevent that thin film from being refreshened by fresh sea water. This water, becoming stagnate, is rapidly depleted of oxygen and thus deprives the marine life of the vital gas and arrests further damage to the piling. The Applicant has found while this preventative measure works in theory, in actual practice, a great majority of the wraps do not prevent the refreshening of the water trapped between the wrapping and the pile and thus the infestation continues.

Bell, in U.S. Pat. No. 4,983,072 proposed a method of protecting submerged pilings in which the wrap was enhanced by filing the space between the wrap and the piling with a water insoluble filler material, comprised of either sand or silt. While this process may enhance the deprivation of oxygen to the marine infestation, it is cumbersome and if the wrap is penetrated, the sand or silt may be washed away from the piling.

Applicant's invention is directed towards an apparatus and method in the form of a combination wrap and marine acceptable filler composite which can be pumped within the wrap in aerosol form and which solidifies to fill the gap between the wrap and the piling and also fill in any gaps in the piling caused by the aforementioned marine borers.

OBJECTS OF THE INVENTION

An object of the present invention is to provide for a novel method and apparatus for the encasement of submerged timber which is efficasious in preventing infestation of the submerged timber.

A still further object of the present invention is to provide for a novel method and apparatus for the encasement of submerged timber which can be installed about the submerged timber in situ.

A still further object of the present invention is to provide for a novel method and apparatus for the encasement of submerged timber which is efficasious in protecting new submerged timber as well as preventing further infestation and weakening of submerged timber which has been attacked by marine microorganisms.

A still further object of the present invention is to provide for a novel method and apparatus which can be easily installed about submerged timber.

SUMMARY OF THE INVENTION

A method and apparatus for the encasement of submerged timber in order to protect the submerged timber from marine infestation or to halt any further infestation of the submerged timber utilizing a polyvinyl wrap of approximately 40 mil thickness, which wrap is secured about the submerged timber from the base of the submerged timber as it emerges from the bottom to a point above the mean high water mark of the submerged timber and then providing one or more inlet openings in the wrap for the introduction of an aerosol foam, preferably utilizing a nitrogen propellant. The injected foam is Coast Guard approved marine grade foam which may be enhanced with a freeze thaw inhibitor, a fire retardant, and viscosity enhancers such that the foam will fill all voids in the submerged timber and all voids between the submerged timber and the polyvinyl wrap with the foam, upon setting, adhering to both the submerged timber and the interior surface of the polyvinyl wrap.

BRIEF DESCRIPTION OF THE DRAWINGS

These and other objects of the present invention will become evident, particularly when taken in light of the following illustrations wherein.

DETAILED DESCRIPTION OF THE DRAWINGS

Figure 1:
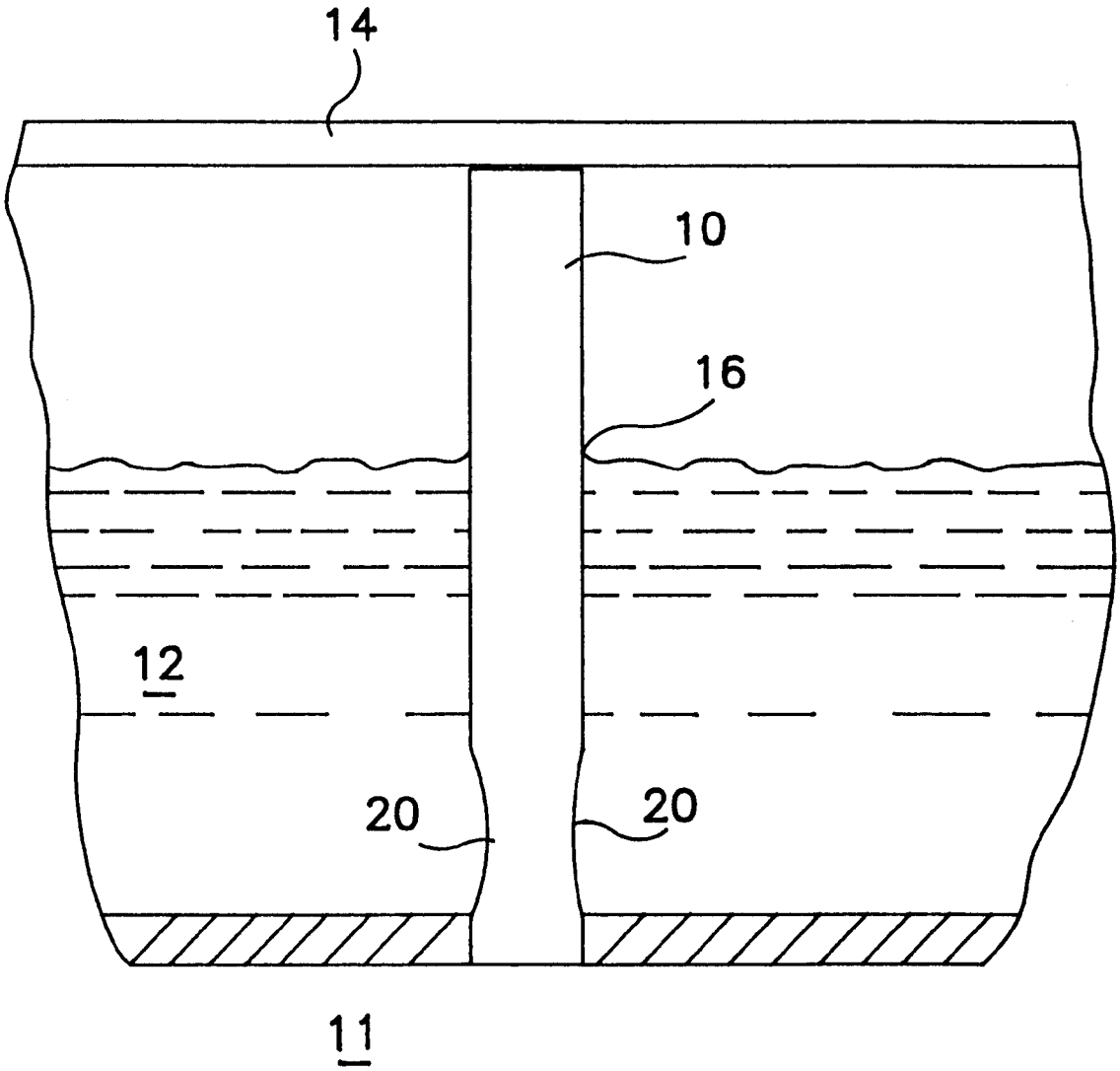
FIG. 1 is a side view illustration of a typical submerged timber or wooden pile which has been subjected to marine infestation as a result of marine microorganisms or marine borers.

FIG. 1 illustrates a side view of a typical piling in position which has suffered the infestation of marine microorganism and marine borers. The typical pile 10 has been driven into the silt or sandy bottom 11 of the ocean or salt water estuary 12 to a sufficient depth to provide stability and a pier, bulkhead or other structure 14 has been constructed on top of the piling 10. The piling 10 comprises a normally generally cylindrical member which is subject to attack from the ambient atmosphere above the high tide point 16 and the action of the tide of the salt water ocean or estuary below high tide point 16. It is the area below the high tide mark 16 which suffers from the infestation attack of microorganisms or micro borers. In FIG. 1, there is illustrated a typical attack from the microorganism or micro borer limnoria, which attacks the submerged portion of the timber or wood pile 10 in great numbers and causes the honeycomb or hourglass effect which is not normally visible to the observer above the surface of the water. This attack can reduce the supporting strength of the wooden or timber pile by as much as 15% per year if gone untreated. In this particular infestation attack, it can be seen that the piling has undergone severe deterioration 20 proximate its lower end to the extent such that the pier or structure which the pile is supporting is in danger. If this attack were to occur on a sufficient number of adjoining pilings, any structure on the pier 14 supported by the piling 10 would present a dangerous situation not only for the structure, facility, but also the individuals who work or travel therethrough.

While the result of the infestation illustrated in FIG. 1 is shown proximate to the silt or sandy base 11 of the ocean or estuary 12, the infestation and resultant weakening of the piling could occur anywhere along the longitudinal axis of the piling that is repetitively positioned below the high tide mark 16.

Figure 2:
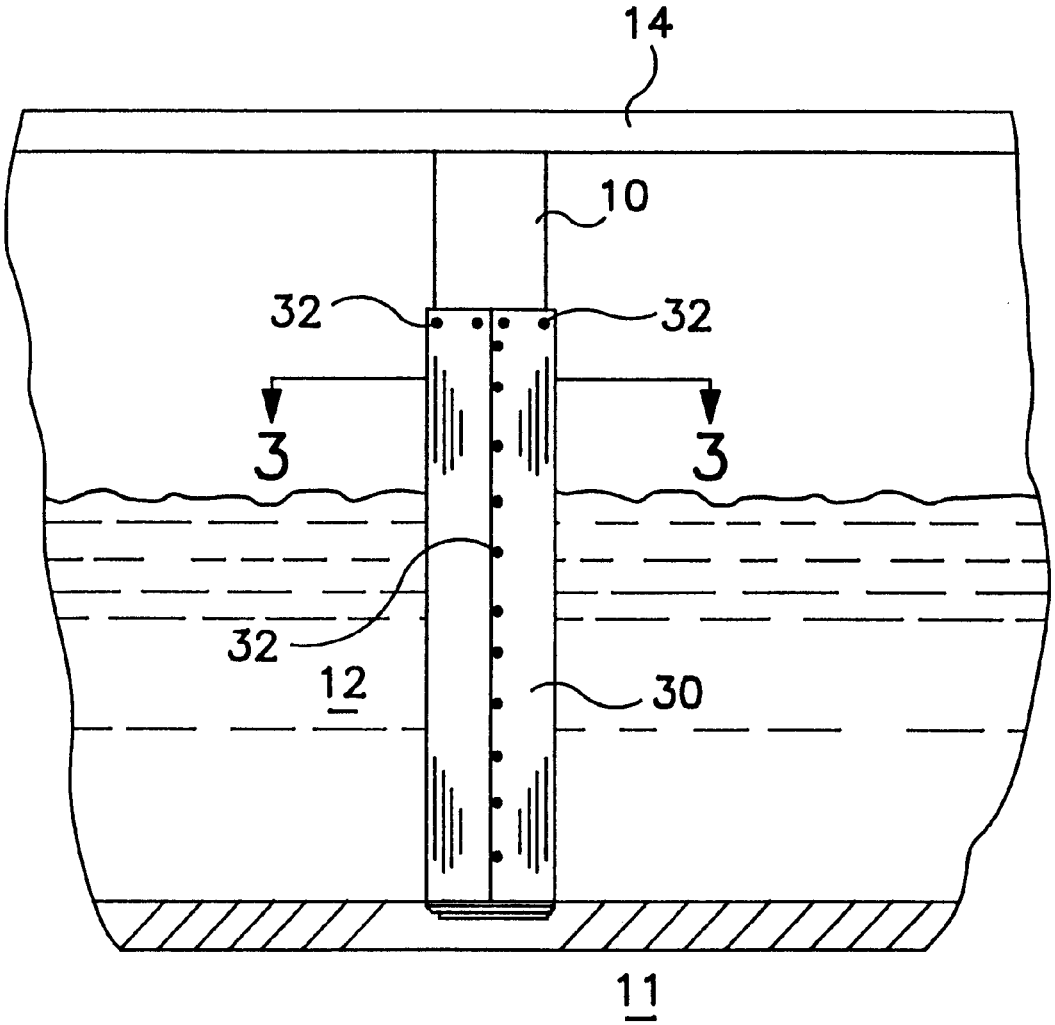
FIG. 2 is a side view illustration and representation of the manner in which a wrap is utilized to protect the encapsulated, submerged, wooden or timber pile from infestation.

FIG. 2 illustrates a piling with a wrapping secured thereabout as taught in U.S. Pat. No. 3,027,610 to Ladell and U.S. Pat. No. 4,983,072 to Bell, with variations. The object in both of the aforesaid patents is to perform the wrapping so as to present a stagnant water area between the wrapping 30 and the outer circumference of the piling 10 so as to deprive the marine microorganisms and marine borers from oxygen. Bell would provide a similar wrapping albeit of different structure, combined with a filler between the inner circumference of the wrapping 30 and the outer circumference of the piling 10.

The problem associated with each of the aforesaid solutions is verifying the integrity of the wrapping, the possibility of a defect or cut in the wrapping and the loss of filler material, and the manner in which the wrapping is secured to the piling to ensure that a stagnant layer of water is entrapped between the wrapping and the piling to ensure the cut off of oxygen supply to the marine borers and therefore the death or stoppage of their infestation.

Heretofore, it has been assumed that a wrapping resulted in the entrapment of a stagnant film or layer of water between the wrapping and the piling that would perform as advertised, namely, the prevention or denial to the marine microorganism or micro borer of oxygen, thus causing the death of the marine microorganism or marine borer. Applicant has developed a test procedure which has shown that this is not always the case and therefore the need for the development of a method and apparatus in the form of a better wrap combination is required in order to insure that the marine microorganisms and marine borers are effectively deprived of oxygen as a result of wrapping of the submerged timber.

In most instances, the wrapping 30 is comprised of a flexible sheet of UV-resistant material of an approximate thickness of 3 mm which can be sealed about the submerged wooden or timber piling by wrapping it about same, and securing it to the piling around the upper and lower ends by means of fasteners 32 or ring clamps as taught by Bell and Ladell, and along the longitudinal seam 34 thereof, by nails 32 or other suitable material. In normal installation, the lower end of the wrap would be secured about the piling below the silt or sand bottom 11 of the ocean or estuary 12 and the upper portion would be secured about the timber or wood piling sufficiently above the high tide mark 16 such that it would insure that the salt water would never rise above the wrapping. In this configuration, it was thought that the wrapping would provide a stagnant annular circumferential layer of water 36 about the piling which would eventually be depleted of oxygen and thereby deprive the marine microorganism or marine borer of the oxygen within which to survive. See FIG. 3.

Figure 3:
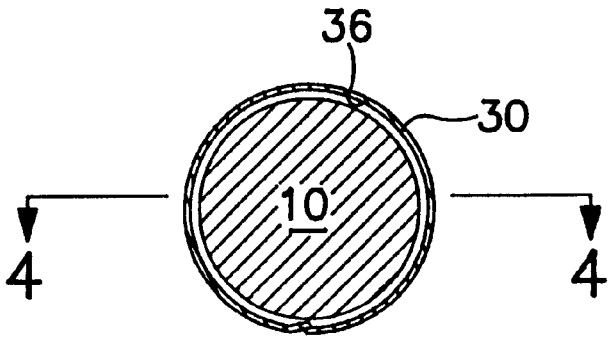
FIG. 3 is a top view along plane 3—3 of FIG. 2 of a wrapped piling.
Figure 4:
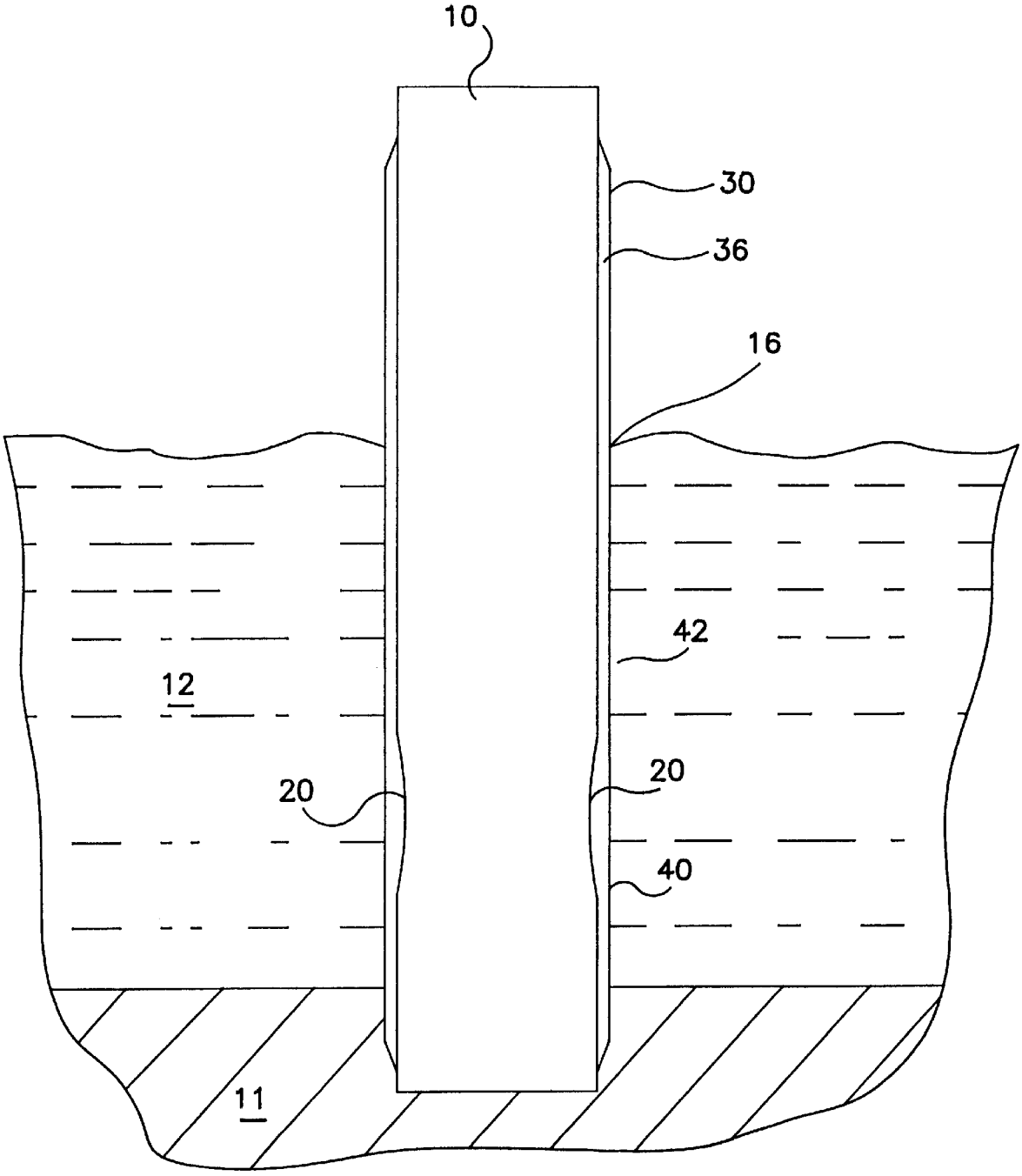
FIG. 4 is a side view along plane 4—4 of FIG. 3 of the manner in which a wrap is used to encapsulate a wooden or timber pile.

FIG. 4 is a side view along plane 3.3 of FIG. 3 further illustrating the manner in which a wrap 30 is positioned about a piling 10. It can be seen that a gap exists between the wrap 30 and the outer circumference of piling 10 and if the wrap 30 were truly installed in a correct and water tight manner, the desired effect of depletion of oxygen in the water found within gap 36 would result in the halting of deterioration of piling 10 by the marine microorganisms or micro borers. However, as pointed out, Applicant as a result of a novel test procedure, has determined that the wraps do not necessarily function in this manner such that oxygen depletion and starvation of the microorganisms and marine borers occurs.

Figure 5:
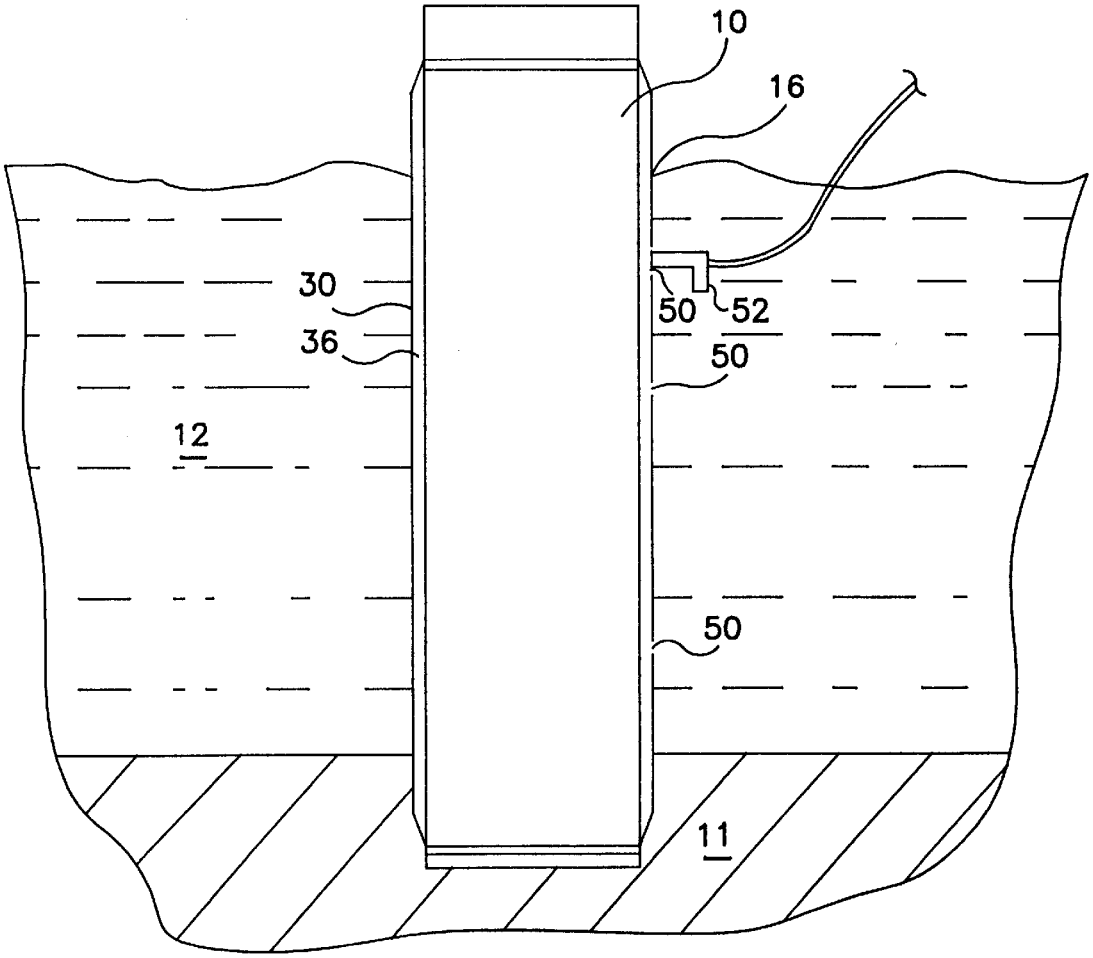
FIG. 5 is a side, cross-section view of a submerged wooden or timber pile illustrating the inlets for introduction of foam into the void area between the wrap and the submerged wooden or timber pile.
Figure 6:
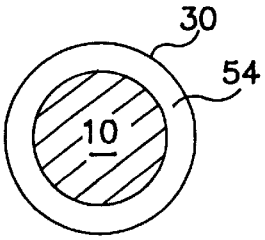
FIG. 6 is a top cross-section view illustrating the wrap, the submerged wooden or timber pile and the introduced foam.

FIG. 5 is a side cross-section view of a submerged wooden or timber pile 10 illustrating the positioning of a wrap 30 about the timber piling 10 for accommodating applicants encapsulation process. Typically, two types of wrap are utilized. One is commonly referred to as a hard wrap. It is of a thicker, stiffer construction than the second type of wrap referred to as a soft wrap. The problem with a hard wrap is that because of its structural integrity, it cannot be tightly wrapped about a submerged piling and hence there is usually extra space left between the wrap and the piling when one utilizes a hard wrap.

The problem associated with a soft wrap is that the fasteners used to tighten it about the piling often times cut holes in the soft wrap thereby destroying the wraps ability to create the barrier of stagnant water and function as intended. Applicant's method and apparatus has application to both hard and soft wraps.

As illustrated in FIG. 5, once the wrap is in place about the piling, a series of apertures 50 are introduced into the wrap for receipt of an injection nozzle. The injection nozzle 52 is in communication with a pressurized container of Coast Guard approved marine grade foam 54 which may be enhanced for this specialized process. The foam 54 may have a freeze thaw inhibitor and viscosity enhancers such that upon its injection to the space between the wrap 30 and the pile 10, the foam 54 will fill all voids, even those created by marine microorganisms and marine borers and displace the water from between the wrap and the pile to create an oxygen depleted barrier. Typically, the foam 54 is introduced by means of a propellant which nitrogen has found to be a suitable such propellant.

Applicant has found that the preferred foam for utilization in Applicant's process is that disclosed in U.S. Pat. No. 5,032,623 to Keske, which is comprised of a reaction mixture of isocyanate, up to about 20% by weight $CHClF_2$, up to about 2% by weight water, and a combination of polyols having an average OH number from about 300 to 500 further comprising polyalkoxylated glycerine having an OH number of from about 200 to about 300 and in which the alkoxy groups each have from two to about three carbon atoms.

This foam has been used in testing and cross sections taken from piles wrapped and encapsulate with the aforementioned foam having shown total encapsulation between the wrap and the outer diameter of the pile and that further, the foam has penetrated and filled voids and areas of deterioration caused by marine borers.

In operation, the injection nozzle 56 penetrates the wrap in several locations depending upon the length of the piling and is introduced by means of a trigger release by a diver. The foam 54 has sufficient buoyancy that it rises to the top of the void area between the wrap 30 and piling 10 and forms a seal and thus begins to displace the water and fill all voids between the wrap and the pile. The process is repeated at several levels of the pile and wrap depending upon the height of the pile. The foam 54 is designed to flow at a proper viscosity to fill even the smallest voids and to then expand and displace the water without damage to the wrap or the seals. The foam also serves to seal the puncture holes utilized to introduce the foam into the space between the wrap and the pile and any other holes which the wrap may have experienced.

Upon setting, the foam will have flowed into all the voids between the wrap and the piling, including those areas where infestation has previously taken place. Upon setting, the foam will adhere not only to the piling 10, but also to the inner surface of wrap 30.

In actual operation, the injection of the foam 54 starts proximate to the top of the wrap to insure that a top seal is formed such that the foam will then flow and solidify downwardly forcing the water between the wrap and the pier to exit through any seals which are not working or any other voids in the wrap. The foam itself will seal all holes and voids in the wrap including those made to inject the foam. In operation it has been found that it takes approximately four to six minutes to successfully inject foam 54 between the wrap and the pier and it takes approximately two minutes for the foam to set.

The amount of foam required per piling or pier depends upon the integrity of the wrap and the manner in which it was placed about the piling or pier, as well as the amount of deterioration suffered by the piling or the pier. The void between the wrap and the pier can be as little as one inch, but if infestation is present, the void between the wrap and the pier where the infestation has taken place can be as much as six inches. Therefore, the amount of foam to seal a particular pier or piling will vary depending upon the tightness of the wrap and the infestation which the pier or piling has suffered.

In a typical destructive test carried out by Applicant, a pile which extended a distance of eight feet from the bed of the body of water to the mean high water mark and which exhibited marine infestation was wrapped from a point slightly below the bed of the body of water to a point at the mean high water mark. Based on that length, a diver successively formed three apertures, one proximate the top, one proximate the middle and one proximate the bottom. The filling of the annular space formed by the wrap and the outer circumference of the pile was then subjected to the introduction of the pressurized foam. The filling was started at the top aperture to insure that a seal was formed such that successive foam introduced at the lower apertures would not escape upwardly. The foam was successively introduced into the top, middle and bottom hole. The foam set in approximately two minutes and it took the diver approximately four to six minutes to successively introduce the foam into the three apertures. The foam itself upon setting self-sealed the apertures formed by the diver and sealed any other apertures in the wrap.

After a suitable period of time, the pile was subjected to destructive testing by cutting cross sections of the pile at various heights below the mean high water mark. The pile in question was a 12 inch diameter pile and the wrap about the pile formed an approximate 1 inch to 1½ inch annular space between the wrap and the outer circumference of the pile where the pile had not been subjected to marine infestation. The cross sections taken established that the foam had filled the entire annular space between the pile and the wrap where no marine infestation had taken place and had filled those portions of the pile where marine infestation had taken place and the diameter of the pile had been significantly reduced. For example, in one instance, the foam filled a marine infestation void of approximately 4 inches in depth and 12 inches in linear longitudinal direction. Test cuts taken exhibited no water or water channels which would allow water to flow towards the outer circumferential surface of the pile.

Subsequent tests were conducted on piles which had been previously wrapped. The same procedure for the introduction of the foam was followed and after suitable time, destructive testing in the form of the cutting of cross sections of the pile at various heights was accomplished. In this instance, the foam was found to have self-sealed the apertures formed for the introduction of the foam as well as sealing apertures previously formed in the wrap. Again, the examination of the foam in relationship to the wrap and the outer circumference of the test pile revealed that the foam had filled all of the voids and apertures between the wrap and the outer circumference of the test pile, including those areas where substantial marine infestation had already taken place.

The present invention has been described with respect to the exemplary embodiments thereof, and will be recognized by those of ordinary skill in the art that many modifications may be made without departing from the spirit and scope of the invention. Therefore the invention is intended to be limited only by the scope of the claims and the equivalence thereof.

I claim:

1. A process for creating a controlled environment and encapsulating a pile submerged in a body of water for protection from marine infestation comprising the steps of:

a. providing a tubular jacket about said pile, said tubular jacket having a lower end secured about said pile proximate its position in an underlying strata beneath a bed of water, said tubular jacket having an upper end secured about said pile proximate the mean high water mark of said body of water, thereby forming an annular enclosed space between said pile and said jacket; and b. forming a first aperture proximate said upper end of said jacket; and c. injecting foam into said first aperture, said foam filling said annular space between said pile and said jacket, proximate said upper end of said jacket said foam comprising a mixture of isocyanate, up to about 20% by weight $CHClF_2$, up to about 2% by weight of water and a combination of polyols having an average OH number of from about 300 to 500 and comprising polyalkoxylated glycerine having an OH number of from about 200 to about 300 in which the alkoxy groups each have from 2 to about 3 carbon atoms; and d. forming successive apertures below said first aperture and successively injecting foam into said apertures to fill said annular space between said pile and said jacket from said upper end of said jacket to said lower end of said jacket; and e. allowing said foam to set.

2. The process in accordance with claim 1 wherein step a further comprises the step of the securing of a longitudinal seam on said jacket from said lower end to said upper end to form said annular space.

3. The process in accordance with claim 1 wherein step a requires the securing of said lower end of said jacket about said pile below said underlying strata of said body of water.

4. The process in accordance with claim 1 further including the step of forming a seal at the upper end of said jacket immediately following step (c).

5. The process in accordance with claim 1 wherein the step of injecting foam into successive appertures further includes the step of displacing water from said annular space between said pile and said jacket.

6. A process for providing a controlled environment and preventing the marine infestation of a partially submerged pile, wherein said pile is wrapped by a tubular jacket extending from a lower end at a point proximate the base of said pile to an upper end at a point above the mean high water mark, forming an annular space between said jacket and said pile, the process comprising:

a. forming a first aperture proximate said upper end of said pile; and b. injecting foam into said first aperture as a filler for said annular space between said jacket and said pile said foam comprising a mixture of isocyanate, up to about 20% by weight $CHClF_2$, up to about 2% by weight of water and a combination of polyols having an average OH number of from about 300 to 500 and comprising polyalkoxylated glycerine having an OH number of from about 200 to about 300 in which the alkoxy groups each have from 2 to about 3 carbon atoms; and c. forming successive apertures below said first aperture for the further introduction of said foam into said annular space between said pile and said jacket; and d. repeating step b until said foam has filled said annular space between said pile and said jacket from said point above said mean high water mark to said lower end of said jacket thereby displacing water from said annular space between said pile and said jacket; and e. simultaneously sealing said apertures formed to introduce said foam into said annular space with said foam.

7. An apparatus for creating a controlled environment about at least a portion of a submerged pile comprising:

a. a jacket for encapsulating a desired portion of said pile, said jacket being tubular in shape, having a lower end secured about said pile proximate its position in an underlying strata beneath a bed of water, said jacket having an upper end secured about said pile proximate the mean high water mark of said body of water, thereby forming an annular enclosed space between said pile and said jacket; and b. a plurality of apertures depending successively from said upper end of said jacket to said lower end; and c. a pressurized, expandable foam said foam comprising a mixture of isocyanate up to about 20% by weight $CHCLF_2$, up to about 2% by weight of water and a combination of polyols having an average OH number of from about 300 to 500 and comprising polyalkoxylated glycerine having an OH number of from about 200 to about 300 in which the alkoxy groups each have from 2 to about 3 carbon atoms and a means for introducing said pressurized expandable foam successively into said apertures from said upper end to said lower end displacing water in said annular space and filling said annular space with said foam upon setting, said foam self-sealing said successive apertures formed in said jacket.

8. The apparatus in accordance with claim 7 wherein the said pressurized, expandable foam is marine grade.

9. The apparatus in accordance with claim 7 wherein said combination of said jacket and said foam forms a water tight seal about said pile.

10. The apparatus in accordance with claim 7 wherein said combination of said jacket and said foam denies water access to that portion of said pile encapsulated by said jacket.

* * * * *